US005152317A

United States Patent [19]

Dörr

[11] Patent Number: 5,152,317

[45] Date of Patent: Oct. 6, 1992

[54] REDUCING STATION HAVING A SAFETY FUNCTION IN A NEGATIVE DIRECTION OF ACTION

[75] Inventor: Hermann Dörr, Herzogenaurach, Fed. Rep. of Germany

[73] Assignee: Siemens Aktiengesellschaft, Munich, Fed. Rep. of Germany

[21] Appl. No.: 756,534

[22] Filed: Sep. 9, 1991

Related U.S. Application Data

[30] Foreign Application Priority Data

Mar. 7, 1989 [DE] Fed. Rep. of Germany ..... 3907288

[51] Int. Cl.[5] ..... F16K 31/04; F16K 31/50

[52] U.S. Cl. ..... 137/487.5; 251/129.11; 251/249.5

[58] Field of Search ..... 137/487.5; 251/129.11, 251/249.5

[56] References Cited

FOREIGN PATENT DOCUMENTS 2416653 10/1975 Fed. Rep. of Germany .

*Primary Examiner*—Gerald A. Michalsky

*Attorney, Agent, or Firm*—Herbert L. Lerner; Laurence A. Greenberg

[57] ABSTRACT

A reducing station has a safety function in a negative direction of action for metering energy flows in the form of gases, steam or water, in particular in thermal or industrial power plants. An operating leg of a servo valve is supplemented by at least one further safety leg of displacing a first spindle section carrying a restrictor body at one end, into a closed position. The displacement is effected as a function of an applied pressure-monitor tripping signal. A second spindle section is coupled to the other end of the first spindle section through preloadable springs and non-self-locking, securely brakeable safety-spindle thread stages. The second spindle section has a spindle drive which transmits an axial thrust or pull to the first spindle section through the securely braked safety-spindle thread stages, in a regulating mode. In a tripping mode, the second spindle section forms an abutment for the movement of the first spindle section with the restrictor body into a desired, closed position. The movement is released by the safety spindles. At least two safety legs each have one non-self-locking safety-spindle drive. Both safety legs can act on a rocker-like, two-armed safety lever. The safety legs can be tested as to their function.

15 Claims, 3 Drawing Sheets

100
80
90
a
SV
7
BS
6
ST
27b
27a
26a
26b
22b
20b
8
5
9
22a
20a
21b
24b
14
24a
21a
23b
23a
33
4.2
13
10a
37a
25a
K1
K2
37b
34
28b
15'
15
29
32a
28a
fl1
fl
31b
32b
30
fl2
31a
35
S2
4.1
4
36
S1
10
11
BS
f1
12
19a
I
1
18b
19b
3
18a
2a f2
16
15a
17
P
2b
II
16
15b
17
P

REDUCING STATION HAVING A SAFETY FUNCTION IN A NEGATIVE DIRECTION OF ACTION

CROSS-REFERENCE TO RELATED APPLICATIONS

This application is a continuation of International application Ser. No. PCT/DE90/00161, filed Mar. 6, 1990.

The invention relates to a reducing station having a safety function in a negative direction of action for metering energy flows in the form of gases, steam or water, in particular in thermal or industrial power plants, including at least one servo valve and one restrictor body being adjustable relative to the valve seat of the servo valve for setting a restriction cross-section through which working medium can flow, a spindle drive disposed in an operating leg for the valve spindle and an output-shaft journal, wherein rotation of the output-shaft journal being converted by the spindle drive into an axial movement of the valve spindle and therefore into a regulating movement of the restrictor body, and a regulating drive coupled to the output-shaft journal and having a regulating motor for displacing the restrictor body into a desired position.

In process and power-plant technology, energy flows of the most varied type have to be reduced or metered. This is done mainly through appropriate reducing valves in combination with various servo drives. At the same time, all pipeline systems and vessels or components must be protected against excessive pressures.

Such tasks are mostly undertaken by safety valves having the most varied types of construction. In that case and in the discussion that follows, the term safety valve, within the scope of this application, will mean a servo valve having an additional safety function in a negative direction of action.

A reducing station of the type mentioned initially above is to undertake both tasks, namely a defined reduction or metering of the energy flows and the protection of the plant systems disposed downstream from excess pressures. If such reducing stations are steam valves in which the steam is simultaneously cooled by the supply of cooling water, the reducing stations are referred to as steam-converting safety stations.

If the systems located downstream of the safety valves in the direction of flow have to be protected from excess pressure, the safety valves are referred to as safety valves having a negative direction of action. Such safety valves must close reliably.

It is accordingly an object of the invention to provide a reducing station having a safety function in a negative direction of action, which overcomes the hereinaforementioned disadvantages of the heretofore-known devices of this general type and which does so in such a way that the safety function can be performed with a very high degree of reliability. In particular, the object is to reliably protect the plant systems disposed downstream in the direction of flow from excess pressure through the reliable closure of the safety valve, to ensure this regulating function even if the supply voltage fails, in order to increase the regulating speed of the safety valve as compared with previous congeneric valves, and to construct the safety station having the novel safety valve in such a way that it is more favorable in its pricing than previous systems.

With the foregoing and other objects in view there is provided, in accordance with the invention, a reducing station having a safety function in a negative direction of action for metering energy flows in the form of gases, steam or water, especially in thermal or industrial power plants, comprising at least one servo valve having a valve seat, a restrictor body being adjustable relative to the valve seat for setting a restriction cross-section through which working medium can flow, an output-shaft journal, a valve spindle connected to the restrictor body, an operating leg, a spindle drive disposed in the operating leg for converting rotation of the output-shaft journal into axial movement of the valve spindle to regulate movement of the restrictor body, and an outflow side, a regulating drive having a regulating motor and being coupled to the output-shaft journal for displacing the restrictor body into a desired position, the valve spindle being subdivided into a first spindle section disposed toward the restrictor-body for actuation by the inherent medium, and a second spindle section disposed toward the spindle drive, a flexible or springy coupling, a safety leg having a selectively rigid and disengaged safety coupling, the spindle sections being force-lockingly coupled to one another by the flexible coupling and the safety coupling, the safety leg being parallel to the operating leg for disengaging the safety coupling to release the first spindle section for performing a quick shut-off of the restrictor body being actuated by the inherent medium and by spring force, when a response pressure reaches or exceeds a permissible value at the outflow side of the servo valve.

The advantages achievable with the invention can in particular be seen in the fact that by using at least one additional safety leg, very high reliability for the safety tripping action is provided without relatively expensive hydraulic systems which require intensive maintenance.

In accordance with another feature of the invention, there is provided at least one pressure monitor for testing an actual pressure value at the outflow side of the safety valve, the safety coupling being dependent upon a pressure-dependent tripping signal from the at least one pressure monitor.

In accordance with a further feature of the invention, the safety coupling includes a non-self-locking safety-spindle drive having a brake device with a brake being released by the pressure-dependent tripping signal being supplied to the brake device.

In accordance with an added feature of the invention, the flexible coupling and the safety coupling transmit axial thrust or axial pull provided by the regulating drive from the second spindle section to the first spindle section, and the second spindle section forms an abutment for movement of the first spindle section and the restrictor body into a desired safety position in the event of tripping, the movement being released by the safety coupling.

In accordance with an additional feature of the invention, the safety-spindle drive has a safety-spindle nut, and the brake device has a brake disc connected to and mounted for rotation with the safety-spindle nut, and a brake magnet normally holding the safety-spindle nut in place on the brake disc and releasing the safety-spindle nut for rotation to release the first spindle section for axial movement into a closed position, in the event of the pressure-dependent tripping signal being supplied.

In accordance with yet another feature of the invention, the valve spindle has an axis, and the first spindle section has an end facing away from the restrictor body, and including a safety lever being linked to the end of the first spindle section and having at least one free end, a non-self-locking safety-spindle of the safety leg running substantially parallel to the axis of the valve spindle, and a slot joint linking the at least one free end of the safety lever to the non-self-locking safety-spindle.

In accordance with yet a further feature of the invention, there is provided a housing for the safety-spindle drive and the brake device, and a housing bridge rigidly coupling the housing to the the second spindle section and mounting the housing in a longitudinally displaceable manner together with the second spindle section.

In accordance with yet an added feature of the invention, the safety lever is rocker-like and has at least two-arms, and the at least one free end of the safety lever is two ends, and including a pivot bearing linking the safety lever to the end of the first spindle section, and another safety leg having another safety spindle, each of the safety spindles being linked to a respective one of the free ends of the safety lever. Accordingly, at least two safety legs are provided having a safety lever with a two-armed construction like a rocker. More than two, for example three safety legs can be used, so that a one-of-three tripping condition can be realized for the tripping action.

The invention thus provides an operating leg which has the valve spindle in the direction of its lines of force and at least one additional safety leg. If a plurality of safety legs are provided, the tripping of the safety stroke can be effected by each individual safety leg, as already explained. The operating leg is essentially formed of the motor-driven servo drive and spindle drive and the regulating member. The additional safety legs, which are independent of one another, are disposed between the spindle nut and the regulating member of the operating leg. They are formed of safety spindles having securely brakeable, non-self-locking thread stages and at least one preloaded spring. In the securely braked state, the safety legs form a rigid connection between the second spindle section and the first spindle section of the operating leg. The safety stroke is actuated by the inherent medium and assisted by spring force. The safety stroke is performed through the safety legs by lifting the associated brakes at the spindle nuts of the non-self-locking thread stages of the safety legs. The safety-spindle shafts, which are fixed in such a way as to be locked against rotation, are pressed into the nuts by the force of the inherent medium and the at least one preloaded spring, and they set the nuts in rotation when the brake is lifted, thereby enabling the regulating member to close reliably. In the process, the safety legs work completely independently of one another. Lifting of the brake on just one safety leg is sufficient to reliably close the regulating member. Ball-roller spindles, for example, or screw spindles having correspondingly larger pitch, can be used for the securely brakeable, non-self-locking thread stages of the safety legs. Furthermore, it is advantage in certain operating cases, for the safety legs to also be tested below the safety pressure.

In accordance with yet an additional feature of the invention, there is provided at least one other non-self-locking safety-spindle drive having a brake device with a brake, the safety-spindle drives and the brake devices having housings, and a common housing bridge firmly connecting the housings to one another, the housing bridge being firmly connected to the second spindle section.

In accordance with again another feature of the invention, the flexible coupling between the first and second spindle sections is formed of a preloadable compression-spring configuration being loaded to a greater extent when the safety coupling is not tripped than when the safety coupling is tripped.

In accordance with again a further feature of the invention, the valve spindle has an axis, and the flexible coupling is disposed in the vicinity of the spindle axis between the spindle sections.

In accordance with again an added feature of the invention, the first spindle section has an end facing away from the restrictor body, and including a safety lever being linked to the end of the first spindle section, a pivot bearing linking the safety lever to the end of the first spindle section, the housing bridge being disposed at a distance from the pivot bearing, and the flexible coupling being inserted between the pivot bearing and the housing bridge.

In accordance with a concomitant feature of the invention, the spindle drive of the operating leg has a spindle nut being disposed at and rotatably mounted on the second spindle section, and a spindle-nut housing rotatably mounting and axially fixing the spindle nut to the output-shaft journal.

Other features which are considered as characteristic for the invention are set forth in the appended claims.

Although the invention is illustrated and described herein as embodied in a reducing station having a safety function in a negative direction of action, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
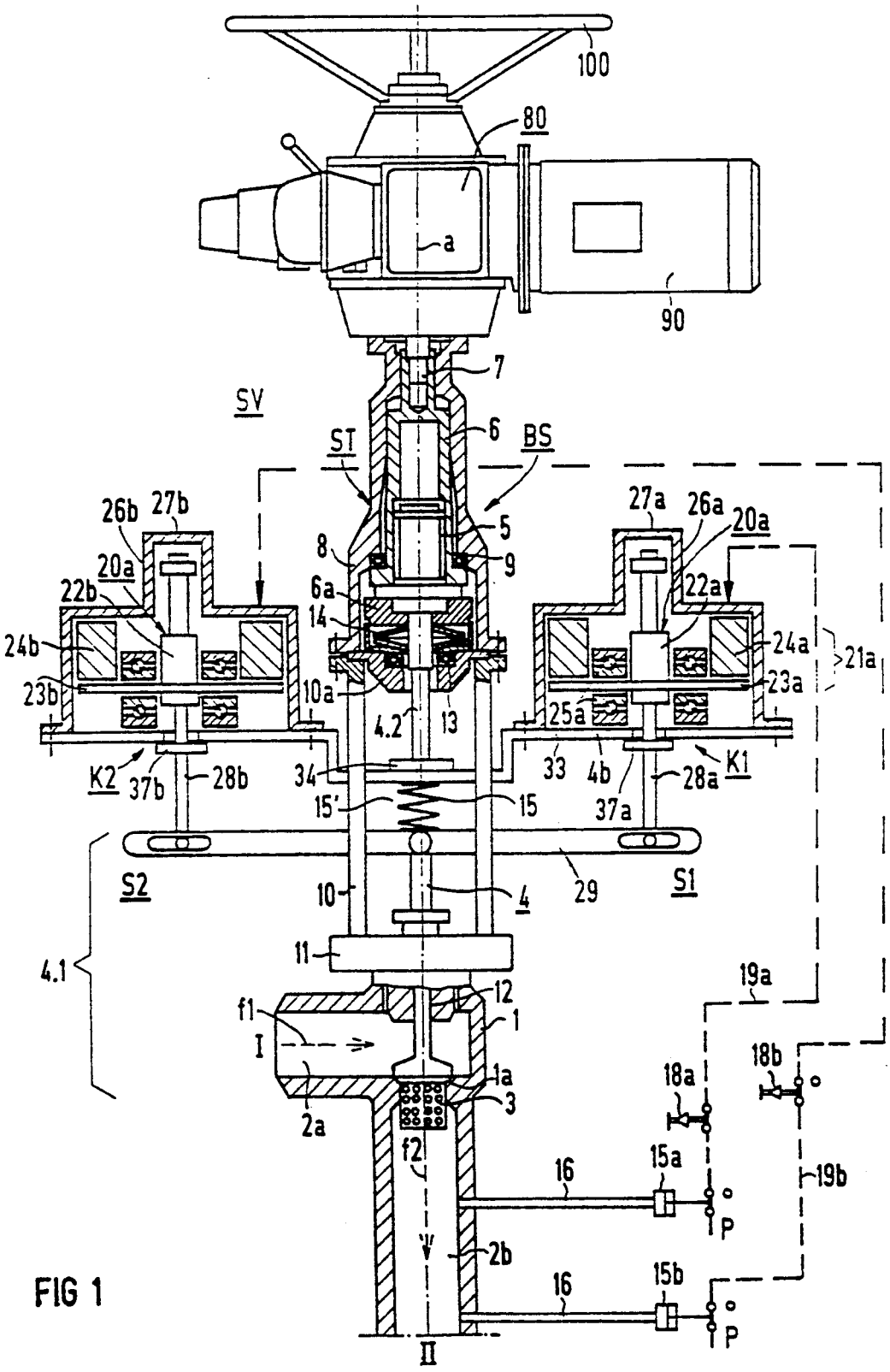
FIG. 1 is a fragmentary, diagrammatic, partly sectional and partly broken-away elevational view of a reducing station having an operating leg and two safety legs in a closed position.

Referring now to the figures of the drawing in detail and first, particularly, to FIG. 1 thereof, there is seen a reducing station for metering energy flows in the form of gases, steam or water. The reducing station is provided in particular for thermal or industrial power plants. The reducing station has at least one servo valve SV with a restrictor body 3 that is adjustable relative to a valve seat 1*a* in a valve housing 1 to which an inflow line 2*a* is laterally connected and from which an outflow line 2*b* leads away toward the bottom. Steam flowing in and away is indicated in broken lines by respective flow arrows f1 and f2, since the servo valve according to FIG. 1 is shown in a closed position of the restrictor body 3. The restrictor body 3 serves to close a restriction cross section downstream of an inflow side I, through which working medium, e.g. steam, can flow, in order to reach a desired position when a response pressure which reaches or exceeds a permissible pressure on an outflow side II of the servo valve SV appears. This applies in the case of a negative direction of action, in other words when systems located after the servo valve in the direction of flow of the arrows f1, f2 have to be protected against excess pressure.

The servo valve SV has an operating leg BS inside which a spindle drive ST having a valve spindle 4, a spindle nut 5, a spindle-nut housing 6 and an output-shaft journal 7, is disposed. Rotation of this output-shaft journal 7 is converted into an axial movement of the spindle 4 by the spindle drive ST. A regulating drive 80 having a regulating motor 90 is coupled to the output-shaft journal 7. The regulating drive 80 is additionally equipped with a hand wheel 100 for adjusting the spindle manually. The regulating drive 80 adjusts the output-shaft journal 7 and thus the restrictor body 3 in order to assume its desired position, in accordance with a manipulated variable fed to it from the network to be regulated and corresponding to a variance between the regulating variable and the desired value. This can be an intermediate position, an open end position shown in FIG. 2 or the closed position shown in FIG. 1. The desired safety position in this safety valve having a negative direction of action, is always the closed position as shown in FIG. 1.

The spindle-nut housing 6 is rotatably mounted inside a spindle housing 8 by means of an axial bearing 9. The spindle nut 5, which is rotatably mounted by an internal thread on an external thread of the spindle 4, is axially fixed inside the spindle-nut housing 6 and is coupled at its outer periphery to the inner periphery of the spindle-nut housing 6 in such a way as to be fixed in terms of rotation. If the spindle nut 5 is thus set in rotation through the output-shaft journal 7 and the spindle-nut housing 6, the spindle 4 is displaced axially in the closing direction or in the opening direction of the restrictor body 3, depending on the direction of rotation. The spindle housing 8 is rigidly connected to a spindle guide body 11 by means of a cage 10. The spindle guide body 11 serves to accurately guide the bottom end of the spindle having the restrictor body 3 and serves to seal a spindle feed-through part 12 by means of a non-illustrated stuffing-box packing. The rotatable mounting of the spindle-nut housing 6 by means of the axial bearing 9 is supplemented by a further axial bearing 13, which is inserted in a recess in a head 10*a* of the cage 10. A disc-spring stack 14, which serves to damp shocks and compensate tolerances, is inserted and supported between the axial bearing 13 and an extension 6*a* of the spindle-nut housing 6. The spindle 4 is disposed in appropriate central recesses and passes through the cage head 10*a*, the axial bearing 13, the disc-spring stack 14 and the extension 6*a*.

According to the invention, the valve spindle 4 is subdivided into a first spindle section 4.1, which is on the restrictor-body side and can be actuated by inherent medium and spring force, and a second spindle section 4.2 on the drive side. The two spindle sections 4.1, 4.2 are force-lockingly coupled to one another through a springy or flexible coupling 15 and a selectively rigid or disengaged safety coupling K1, K2. A force-locking connection is one which connects two elements together by force external to the elements, as opposed to a form-locking connection which is provided by the shapes of the elements themselves. Two of the safety couplings K1, K2 are shown, each of which is part of a respective safety leg S1, S2 disposed parallel to the operating leg BS. When a response pressure which reaches or exceeds a permissible value on the outflow side II of the servo valve SV appears, the respective safety leg S1 or S2 disengages the associated safety coupling K1 or K2 so that the first spindle section 4.1 is thus released for performing quick shut-off of the restrictor body 3, which is actuated by the inherent medium.

Figure 2:
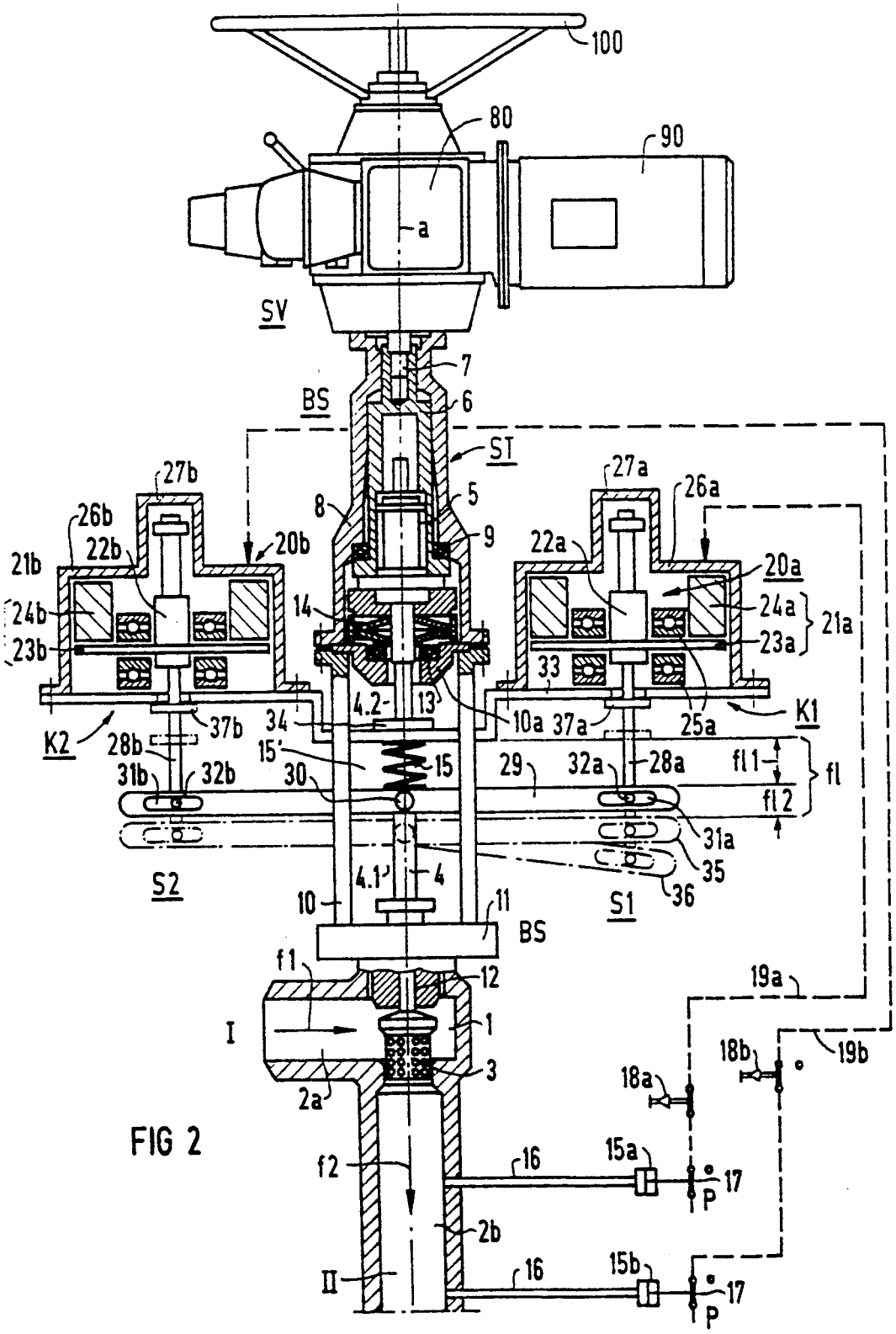
FIG. 2 is a view similar to FIG. 1 showing the device of FIG. 1 in an open position, with a tripping position of a safety lever, during tripping of one or both safety legs, additionally being shown by broken lines.

In FIG. 1 the servo valve is shown in the closed position, in which the restrictor body 3 has been moved into its closed position by the regulating drive 80. In FIG. 2 the restrictor body 3 has been moved into its open end position by the regulating drive 80 so that the maximum cross-section of flow inside the valve housing 1 is cleared. From this open end position or even from any intermediate position of the restrictor body 3, the servo valve can be moved by a quick shut-off into the closed position by means of at least one of the safety legs S1, S2 shown. For this purpose, at least one pressure monitor 15*a*, 15*b* is provided for testing the actual pressure value on the outflow side II of the safety valve SV. In the illustrated case of the use of two safety legs S1, S2, the safety coupling K1 is made dependent upon a tripping signal from the pressure monitor 15*a*, and the safety coupling K2 of the second safety leg S2 is made dependent upon a tripping signal from the pressure monitor 15*b*, as is illustrated by signal lines 19*a*, 19*b* shown in broken lines. Both pressure monitors 15*a*, 15*b* are connected to the interior of the outflow line 2*b* through measuring connections or sockets 16. Both pressure monitors 15*a*, 15*b* have plungers which act on normally closed contacts 17 of the electric signal lines 19*a*, 19*b*, as seen in FIG. 2. The normally closed contacts 17 are each connected in series with keys or push-button switches 18*a*, 18*b* with which the function of the safety legs S1, S2 can be tested manually or in a remotely actuated manner.

The safety coupling K1 will first of all be described below with reference to FIG. 2, while noting that the safety coupling K2 is of corresponding construction. The safety coupling K2 includes a non-self-locking safety-spindle drive 20*a* having a brake device 21*a*. The brake device 21*a* has a brake disc 23*a* which is connected to a safety-spindle nut 22*a* and is mounted in such a way as to rotate with the latter. A brake magnet 24*a*, which in the example is constructed as an electromagnet having a holding function, normally holds the safety-spindle nut 22*a* in place on its brake disc 23*a*. In the event of a pressure-dependent tripping signal being supplied through the signal line 19*a*, the brake magnet 24*a* releases the safety-spindle nut 22*a* for rotation, since the brake magnet 24*a* in this case is de-energized, that is, made dead. The rotatable mounting of the safety-spindle nut 22*a* and its brake disc 23*a* is diagrammatically indicated by two axial bearings 25*a*. A housing of the safety coupling K1 is designated by reference symbol 26*a*. The housing 26*a* has a hood-shaped widened portion 27*a*, so that there is sufficient clearance space for the movement of a safety spindle 28*a*.

Before further details of the tripping action are described, the construction and function of a safety lever 29 and a housing bridge 33 will first be explained. In the region of a joint location 30 shown in FIG. 2, the safety lever 29 is pivotally linked to an end of the first spindle section 4.1 facing away from the restrictor body 3. This joint location 30 can be realized, for example, by a pivot bearing. The safety lever 29 has at least one free end and it is shown as a double lever in the form of a rocker having two slotted holes 31*a*, 31*b* at its two ends. The safety leg S1 has the non-self-locking safety spindle 28*a* which has a flange 37*a*, runs essentially parallel to a valve-spindle axis a, and is linked to the free end of the safety lever 29 having the slotted hole 31*a*, by a slot joint having a pivot 32*a* which is seen in FIG. 2. The housing 26*a* for the safety-spindle drive 20*a* and the brake device 21*a* is rigidly coupled to the second spindle section 4.2 by the housing bridge 33 having a portion 4*b* and is mounted in a longitudinally displaceable manner together with the second spindle section 4.2.

The reference numerals used for the elements of the safety leg S2 correspond to those used for the safety leg S1, by replacing the letter a with the letter b. In accordance with the structure of the at least two-armed rocker 29, the housings 26*a*, 26*b* for each of the preferably at least two safety-spindle drives 20*a*, 20*b* and their associated brake devices 21*a*, 21*b* are connected to one another through a common housing bridge 33, and furthermore the housing bridge 33 is firmly connected to the second spindle section 4.2, namely through a flange 34 at a free end of the second spindle section 4.2. The springy or flexible coupling 15 between the first and second spindle sections 4.1, 4.2 is formed of a preloaded compression-spring configuration which is loaded to a greater extent when the safety coupling K1 or K2 is not tripped than when the safety coupling K1 or K2 is tripped. In FIG. 2, a compression-spring configuration 15' is therefore preloaded. It is preferably mounted in the region of the spindle axis a between the two spindle sections 4.1, 4.2, since in this case only one compression-spring configuration is needed. In principle it would also be possible to allocate a helical compression spring to each of the two safety spindles 28*a*, 28*b*. A further possibility would be to allocate a torsion spring to the safety-spindle nuts 22*a* and 22*b*. However, the illustrated embodiment of a helical compression-spring configuration lying with its spring axis in the spindle axis is particularly advantageous. Constraining forces are kept away from the spindle feed-through part 12 and thus from the associated stuffing-box packing by the springy or flexible coupling 15.

As mentioned above, the second safety leg S2 with its safety coupling K2 is of corresponding construction to the first safety leg S1 with its safety coupling K1, for which reason the same reference numerals, with the exception of the final letter, are also used for the same parts. The final letter in the first safety leg S1 is a in each case and in the second safety leg S2 is b in each case.

The spindle drive ST of the operating leg BS is allocated to the second spindle section 4.2. As already indicated, it is sufficient for one safety leg S1 or S2 to respond in order to perform the safety function (displacement of the restrictor body 3 from the position according to FIG. 2 into the closed position). Therefore, in principle the safety system can be realized with just one safety leg, although the redundant safety-leg configuration shown, with at least two safety legs S1, S2 working in parallel, is more advantageous. As was likewise already indicated, FIG. 1 and FIG. 2 show the function of a reducing station having a safety function in the closing direction, i.e. the safety valve SV works with a negative direction of action. The safety valve SV is normally open or in an intermediate position, and in the event of a response (pressure in the outflow line 2*b* which is too high) it is displaced into the closed position by the inherent medium and the force of the compression-spring configuration 15'. A steam valve having the housing 1 is shown, and the steam flows against the restrictor body 3 (such as a perforated restrictor body in this case) through the inflow line or inlet piping connection 2*a*. The steam traveling in the direction of the flow arrows f1, f2 exerts an axial force on the restrictor body 3, the spindle 4, the first and second spindle sections 4.1, 4.2, the safety spindles 28*a*, 28*b* and the spindle nut 5. The axial force acts in proportion to the effective cross section of the restrictor body and the pressure difference between the inflow line or inlet piping connection 2*a* and the outflow line or outlet piping connection 2*b* and in the closing direction.

During normal operation, the regulating drive 80 (which can also be referred to as a servo drive) compensates for this force through the output-shaft journal 7 and the spindle-nut housing 6. This regulating drive 80 is self-locking and it has the hand wheel 100 with which the restrictor body 3 can be moved through the spindle 4 into the closed position (FIG. 1) or into the open position (FIG. 2).

In the normal operating state, regarding which the representation according to FIG. 2 will now be considered, the safety-spindle drives 20*a*, 20*b*, which have a non-self-locking construction, are in the retracted state (in accordance with the position shown). At the same time, the two safety-spindles 28*a*, 28*b* are securely braked through the associated safety-spindle nuts 22*a*, 22*b* and the brake magnets 24*a*, 24*b*. Consequently, there is a rigid connection between the safety lever 29 and the housing bridge 33 or between the first and the second spindle sections 4.1, 4.2.

The regulating impulses of the regulating drive 80 pass backlash-free or play-free to the restrictor body 3.

However, if the brake magnets 24*a*, 24*b* become dead (in a closed-circuit construction) due to response of the pressure monitors 15*a* or 15*b*, the rigid connection between the first and second spindle sections 4.1, 4.2 is neutralized. Through the force of the inherent medium (pressure difference at the restrictor body 3) and the compression-spring configuration 15', and through the rotating safety-spindle nuts 22*a*, 22*b*, one or both safety spindles 28*a*, 28*b*, are pulled down by the first spindle section 4.1 through the safety lever 29, which is assisted by the compression-spring configuration 15'.

The restrictor body 3 can always reach the closed end position as soon as the safety stroke is tripped through one of the safety legs S1 or S2. This, of course, also applies during the simultaneous response of the two safety legs S1 and S2. More than two safety legs, e.g. three, could also be provided, in which case a corresponding three-armed rocker would have to be provided for the safety lever 29. During simultaneous tripping of both safety legs S1, S2, the safety lever 29, with a restrictor body 3 displaced into its closed end position, assumes the position (displaced parallel to itself) indicated by a broken line at reference numeral 35. If only the first safety leg S1 had been tripped, the safety lever 29 would have set itself obliquely about a left-hand joint 31*b*, 32*b* and would have assumed a position 36 shown in phantom, in the closed end position of the restrictor body 3, i.e. the tripping would also take place with only one excited safety leg S1. The same would correspondingly apply if only the safety leg S2 had received a pressure tripping signal.

After the response of one or both safety legs, the normal operating position is reached again by subsequent travel of the regulating drive 80 into the closed end position (torque end position), i.e. the spring 15 is loaded again and the safety lever 29 moves back into the horizontal position. In the process, the two brake devices 21*a* and 21*b* of the safety legs are lifted through the control system, or free wheels built into the safety legs always permit rotary movement in the "loading direction".

Both safety legs S1, S2 can be separately tested through the keys 17 and the brake magnets 24*a*, 24*b*. Testing is also possible below the safety pressure.

The spring force of the compression-spring configuration 15' and the spring travel are of such proportions that testing in the pressure-less state of the plant, i.e. without assistance from the inherent medium, can also take place. In the right-hand part of FIG. 2, the length of the compression-spring configuration 15' in the preloaded state is designated by reference symbol f11 and in the relaxed state (tripping position) by reference symbol f1. During the tripping action, the compression-spring configuration 15' is extended by the travel distance f12. Instead of a helical compression-spring configuration, a disc-spring stack, for example, could also be used.

In the tripping case described above, the second spindle section 4.2 forms an abutment for the movement of the first spindle section 4.1 plus its restrictor body 3, into the desired safety position, which movement is released by the safety coupling K1 or K2.

Reference symbols 37*a* and 37*b* in FIGS. 1 and 2 designate stop discs which sit securely on the respective safety spindles 28*a* and 28*b* and have the task of limiting the stroke of the spindles 28*a*, 28*b* during a return movement. In FIG. 2, the stop discs 37*a*, 37*b* are additionally shown by broken lines in the tripping position of the safety spindles 28*a*, 28*b*.

Figure 3:
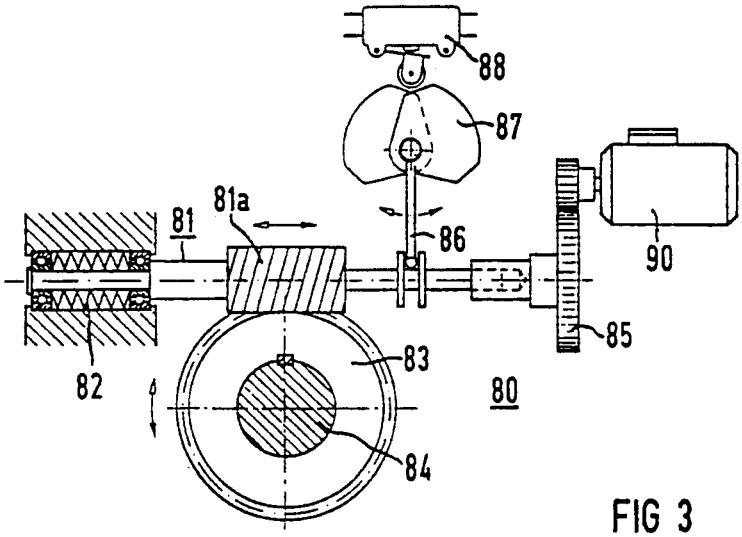
FIG. 3 is a plan view of a gear unit of a regulating drive, with housing walls for the most part being omitted.

FIG. 3 shows the regulating drive 80 having the regulating motor 90, a worm shaft 81, a preloaded disc-spring stack 82 at one end of the worm shaft 81 and an output shaft 84 meshing with a worm 81*a* through a worm wheel 83. The regulating motor 90 acts on the worm shaft 81 through a reduction gear 85. The worm shaft 81 is held centrally relative to the worm wheel 83 by the preloaded disc-springs 82 and is axially displaceable toward both sides. If a load moment occurs at the output shaft 84 which is greater than the moment set by the preloading of the disc-springs, the worm shaft 81 shifts from its center position. As a result, the worm shaft 81 acts through a pivot lever 86 and a cam plate 87 to actuate a torque switch 88 which switches off the regulating motor 90 through non-illustrated control means, e.g. a protected reversing switch. Since the worm shaft 81 is self-locking, it stops in its respective switch-off position.

Figure 4:
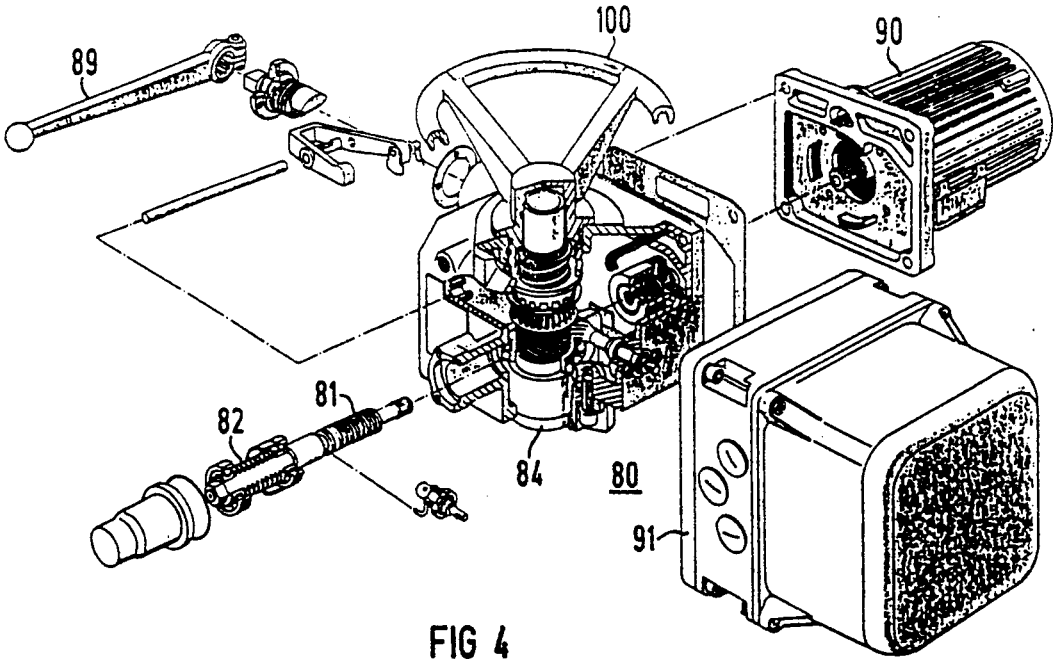
FIG. 4 is a fragmentary, exploded perspective view showing an upper part of the reducing station according to FIGS. 1 and 2 with a regulating drive and a hand wheel thereof, and the latter being in a truncated representation.

The exploded representation according to FIG. 4 reveals the hand wheel 100, the regulating motor 90 as well as a lever 89 for changing over from motor to manual operation. A switching and indicating device is accommodated in a switch box 91. The drive motor 90 is switched off and the hand wheel 100 is coupled onto the output shaft 84 (end shaft) by pressing the change-over lever 89. This position is interlocked by a special non-illustrated mechanism. When the motor 90 starts up, provision is made for the hand wheel 100 to be uncoupled automatically and without risk to the operator, and for the drive motor 90 to be coupled on. Motor operation therefore always takes precedence over manual operation.

I claim:

1. A reducing station having a safety function in a negative direction of action for metering energy flows in the form of gases, steam or water, comprising:

at least one servo valve having a valve seat, a restrictor body being adjustable relative to said valve seat for setting a restriction cross-section through which working medium can flow, an output-shaft journal, a valve spindle connected to said restrictor body, an operating leg, a spindle drive disposed in said operating leg for converting rotation of said output-shaft journal into axial movement of said valve spindle to regulate movement of said restrictor body, and an outflow side, a regulating drive having a regulating motor and being coupled to said output-shaft journal for displacing said restrictor body into a desired position, said valve spindle being subdivided into a first spindle section disposed toward said restrictor-body for actuation by the inherent medium, and a second spindle section disposed toward said spindle drive, a flexible coupling, a safety leg having a selectively rigid and disengaqed safety coupling, said spindle sections being coupled to one another by said flexible coupling and said safety coupling, said safety leg being parallel to said operating leg for disengaging said safety coupling to release said first spindle section for performing a quick shut-off of said restrictor body being actuated by the inherent medium and by spring force, when a response pressure at least reaches a permissible value at said outflow side of said servo valve.

2. A reducing station according to claim 1, wherein said flexible coupling and said selectively rigid and disengaged safety coupling force-lockingly couple said spindle sections to one another.

3. A reducing station according to claim 1, including at least one pressure monitor for testing an actual pressure value at said outflow side of said safety valve, said safety coupling being dependent upon a pressure-dependent tripping signal from said at least one pressure monitor.

4. A reducing station according to claim 3, wherein said safety coupling includes a non-self-locking safety-spindle drive having a brake device with a brake being released by the pressure-dependent tripping signal being supplied to said brake device.

5. A reducing station according to claim 4, wherein said flexible coupling and said safety coupling transmit axial thrust or axial pull provided by said regulating drive from said second spindle section to said first spindle section, and said second spindle section forms an abutment for movement of said first spindle section and said restrictor body into a desired safety position in the event of tripping, said movement being released by said safety coupling.

6. A reducing station according to claim 4, wherein said safety-spindle drive has a safety-spindle nut, and said brake device has a brake disc connected to and mounted for rotation with said safety-spindle nut, and a brake magnet normally holding said safety-spindle nut in place on said brake disc and releasing said safety-spindle nut for rotation to release said first spindle section for axial movement into a closed position, in the event of the pressure-dependent tripping signal being supplied.

7. A reducing station according to claim 4, including a housing for said safety-spindle drive and said brake device, and a housing bridge rigidly coupling said housing to said the second spindle section and mounting said housing in a longitudinally displaceable manner together with said second spindle section.

8. A reducing station according to claim 7, wherein said first spindle section has an end facing away from said restrictor body, and including a safety lever being linked to said end of said first spindle section, a pivot bearing linking said safety lever to said end of said first spindle section, said housing bridge being disposed at a distance from said pivot bearing, and said flexible coupling being inserted between said pivot bearing and said housing bridge.

9. A reducing station according to claim 4, including at least one other non-self-locking safety-spindle drive having a brake device with a brake, said safety-spindle drives and said brake devices having housings, and a common housing bridge firmly connecting said housings to one another, said housing bridge being firmly connected to said second spindle section.

10. A reducing station according to claim 9 wherein said first spindle section has an end facing away from said restrictor body, and including a safety lever being linked to said end of said first spindle section, a pivot bearing linking said safety lever to said end of said first spindle section, said housing bridge being disposed at a distance from said pivot bearing, and said flexible coupling being inserted between said pivot bearing and said housing bridge.

11. A reducing station according to claim 4, wherein said flexible coupling between said first and second spindle sections is formed of a preloadable compression-spring configuration being loaded to a greater extent when said safety coupling is not tripped than when said safety coupling is tripped.

12. A reducing station according to claim 11, wherein said valve spindle has an axis, and said flexible coupling is disposed in the vicinity of said spindle axis between said spindle sections.

13. A reducing station according to claim 1, wherein said valve spindle has an axis, and said first spindle section has an end facing away from said restrictor body, and including a safety lever being linked to said end of said first spindle section and having at least one free end, a non-self-locking safety-spindle of said safety leg running substantially parallel to said axis of said valve spindle, and a slot joint linking said at least one free end of said safety lever to said non-self-locking safety-spindle.

14. A reducing station according to claim 13, wherein said safety lever is rocker-like and has at least two-arms, and said at least one free end of said safety lever is two ends, and including a pivot bearing linking said safety lever to said end of said first spindle section, and another safety leg having another safety spindle, each of said safety spindles being linked to a respective one of said free ends of said safety lever.

15. A reducing station according to claim 1, wherein said spindle drive of said operating leg has a spindle nut being disposed at and rotatably mounted on said second spindle section, and a spindle-nut housing rotatably mounting and axially fixing said spindle nut to said output-shaft journal.

* * * * *